US005826428A

United States Patent [19]

Blaschke

[11] Patent Number: 5,826,428

[45] Date of Patent: Oct. 27, 1998

[54] BURNER FOR THE THERMAL REGENERATION OF A PARTICLE FILTER IN AN EXHAUST GAS AFTERTREATMENT SYSTEM OF AN INTERNAL COMBUSTION ENGINE, ESPECIALLY A DIESEL ENGINE

[75] Inventor: Walter Blaschke, Esslingen, Germany

[73] Assignee: J. Eberspächer GmbH & Co., Esslingen, Germany

[21] Appl. No.: 589,880

[22] Filed: Jan. 23, 1996

[30] Foreign Application Priority Data

Feb. 9, 1995 [DE] Germany ..... 195 04 183.6

[51] Int. Cl.[6] ..... F01N 3/10

[52] U.S. Cl. ..... 60/303

[58] Field of Search ..... 60/303

[56] References Cited

U.S. PATENT DOCUMENTS

| | | | |
|---|---|---|---|
| 4,571,938 | 2/1986 | Sakurai | 60/303 |
| 4,651,524 | 3/1987 | Brighton | 60/303 |
| 4,662,172 | 5/1987 | Shinzawa | 60/303 |
| 4,991,396 | 2/1991 | Goerlich | 60/303 |
| 5,001,899 | 3/1991 | Santiago | 60/303 |
| 5,105,621 | 4/1992 | Simmons | 60/303 |

*Primary Examiner*—Thomas E. Denion
*Attorney, Agent, or Firm*—McGlew and Tuttle

[57] ABSTRACT

Four design variants of a full-flow burner for the thermal regeneration of a particle filter in an exhaust gas aftertreatment system of an internal combustion engine, especially a diesel engine, which is arranged fully in the tailpipe, especially in an expanded, straight coaxial tailpipe section, are suggested according to the present invention. As a result, the flow can enter a particle filter axially, which means simplified design and good temperature distribution. The full-flow burners are preheated by the heat of the exhaust gas of the engine during the start phase. The exhaust gas of the engine cools the burner surface during the phase of burner operation, so that thermal overload is avoided.

38 Claims, 3 Drawing Sheets

BURNER FOR THE THERMAL REGENERATION OF A PARTICLE FILTER IN AN EXHAUST GAS AFTERTREATMENT SYSTEM OF AN INTERNAL COMBUSTION ENGINE, ESPECIALLY A DIESEL ENGINE

FIELD OF THE INVENTION

The present invention pertains to a burner for the thermal regeneration of a particle filter, which is arranged in the tailpipe of an internal combustion engine, especially a diesel engine.

BACKGROUND OF THE INVENTION

P 44 43 133.3 suggests a burner for the thermal regeneration of a particle filter in an exhaust gas aftertreatment system of an internal combustion engine, wherein the burner is arranged coaxially in front of the particle filter, and the exhaust gas flow to be treated is introduced between the burner and the particle filter. As a result, the particle filter cannot be reached by the exhaust gas flow axially, which means, among other things, a complicated design of the exhaust gas aftertreatment system and leads to a non-optimal temperature distribution in the tailpipe in the area of the burner and of the particle filter.

SUMMARY AND OBJECTS OF THE INVENTION

The primary object of the present invention is to provide a burner for the thermal regeneration of a particle filter of the type described in the introduction, which has a simple design and operates highly efficiently, and whose combustion chamber is especially located completely in the exhaust gas flow of the tailpipe.

According to the invention, a burner for the thermal regeneration of a particle filter is provided which is arranged in a tailpipe of an internal combustion engine, particularly a diesel engine. The tailpipe is provided with a section of increased diameter. In the section of increased diameter, a central, coaxial vaporizing combustion chamber is provided. The combustion chamber has a closed, arched flow inlet in an upstream direction relative to the exhaust gas flow and is provided with an opening in the downstream direction. The exhaust gas flow flows around the vaporizing combustion chamber on a jacket circumference.

The vaporizing combustion chamber preferably has a central combustion chamber section in the form of a coaxial perforated pipe. The vaporizing combustion chamber is preferably held and centered in the expanded section of the tailpipe by a first exhaust gas-swirling means arranged in the jacket annular space. The first exhaust gas-swirling means preferably has guide blades.

The upstream flow inlet of the vaporizing combustion chamber preferably has a lateral air inlet channel. The vaporizing combustion chamber preferably has a first lateral fuel supply with a lateral glow means.

The vaporizing combustion chamber or pilot combustion chamber is preferably followed by a second combustion stage. The second combustion chamber stage preferably has a second lateral fuel supply with a closed circular line, which introduces the second fuel supply into the jacket annular space in an area of the first exhaust gas swirling means, wherein the fuel opening end of the second fuel supply is arranged downstream. The second fuel supply preferably extends at least partially in the interior of the first exhaust gas-swirling means and the second fuel supply especially extends through holes of said guide blades of said first exhaust gas-swirling means. A second fuel supply of the second combustion chamber stage includes a timing valve or a mechanical atomizer which valve or atomizer injects the fuel directly into the flame of the vaporizing combustion chamber or pilot combustion chamber.

The vaporizing combustion chamber is preferably followed by a first flame retention baffle, preferably a radiating plate, which is an ignition aid and evaporating surface for the second combustion chamber stage. The first flame retention baffle is coaxially followed by additional flame retention baffles. The additional flame retention baffles are preferably arranged concentrically in the tailpipe section of increased diameter.

The combustion air of the second combustion chamber stage is preferably the residual air of the exhaust gas of the internal combustion engine. The engine exhaust gas flow is preferably divided into a primary flow and a secondary flow for better mixing of the burner exhaust gas and the engine exhaust gas.

According to a second variant of the invention a burner for thermal regeneration of a particle filter is arranged in a tailpipe of an internal combustion engine, particularly a diesel engine. The tailpipe has a straight section of increased diameter in which a pilot combustion chamber is provided in the form of a torch igniter with a lateral flame glow plug, the igniter being fastened to the jacket of the expanded tailpipe section. The housing of the torch igniter has a downstream tapering open end which extends in parallel to an axis of the tailpipe.

The tapering open end of the torch igniter housing is preferably located centrally in the tailpipe. The torch igniter preferably has a lateral ignition air connection. The torch igniter housing preferably has an engine exhaust gas inlet opening in the upstream direction.

The torch igniter is preferably preceded in the upstream direction by a central air diffuser (air shower element) which has a lateral connection piece for the supply of additional air.

The first fuel supply line is preferably arranged in front of the torch igniter. The torch igniter is preferably followed by the second fuel supply line in the downstream direction. The first and second fuel supply lines preferably have a closed circular line on the jacket and line webs, which extend radially into the expanded tailpipe section and are provided with the discharge openings in the downstream direction. The torch igniter with the second fuel supply line is preferably followed by one or more additional coaxial flame retention baffles, which are located in the tailpipe section of increased diameter.

According to a third variant of the invention, a burner for the thermal regeneration of a particle filter which is arranged in a tailpipe of an internal combustion engine, particularly a diesel engine is provided. The tailpipe has a straight tailpipe section of increased diameter in which a second vaporizing combustion chamber with a flame glow plug is provided. The second vaporizing combustion chamber has a fuel supply and the second combustion chamber is arranged at least partially in the section of increased diameter.

The second vaporizing chamber preferably has a second combustion chamber stage. The second vaporizing combustion chamber preferably has a cylindrical part which is open in the upstream and downstream directions and is fastened, via a second exhaust gas-swirling means, in the jacket annular space, between the cylindrical part and the tailpipe.

The flame glow plug is preferably arranged behind the second exhaust gas swirling means in the downstream direction and is fastened in a tangential connection piece of the expanded tailpipe section and extends into the jacket annular space between the cylindrical part and the extended tailpipe section. The additional exhaust gas-swirling means is preferably followed by a second fuel supply, which extends essentially radially into the jacket annular space.

An exhaust gas-deflecting means is preferably arranged behind the flame glow plug and preferably arranged behind the optionally present second fuel supply and is arranged in the jacket annular space. A third fuel supply is preferably arranged behind the exhaust gas deflecting means and is fastened in the expanded tailpipe section.

The second and/or third fuel supply preferably has a jacket closed circular line section, which has radially inwardly directed fuel opening sections. The third fuel supply is preferably located, viewed in an axial direction, approximately in an area of a downstream open end of a cylindrical part of the second vaporizing combustion chamber. The third fuel supply is followed in a downstream direction by one or more additional flame retention baffles, which extend coaxially to the cylindrical part.

According to an additional variant of the present invention, a burner for the thermal regeneration of a particle filter is provided arranged in a tailpipe of an internal combustion engine, particularly a diesel engine. The tailpipe has a straight tailpipe section of increased diameter in which an air atomization combustion chamber is provided, which is a closed, arched flow inlet end in an upstream direction, is open in the downstream direction and around which the exhaust gas flow flows along a jacket circumference. The air atomization combustion chamber is preferably coaxially arranged.

The air atomization combustion chamber preferably has a central air atomization nozzle which is provided with a radial fuel supply line and with a radial air supply line, wherein the air atomization nozzle is followed by a radial igniting means. The arched flow inlet end of the air atomization combustion chamber preferably has an additional radial air supply line. The fuel supply line and the air supply line are preferably followed by a guide means, which also acts as a holder for the air atomization nozzle in the air atomization combustion chamber.

The air atomization combustion chamber is preferably designed as a flame tube with jacket openings in the downstream direction. The downstream end of the flame tube is preferably tapered and is fastened to an inner circumference of the expanded tailpipe section via the exhaust gas guide means. One or more additional coaxial flame retention baffles are preferably arranged behind the air atomization combustion chamber. These additional flame retention baffles are preferably followed by an expanding coaxial mixing space with the guide means, which is joined by the particle filter in the tailpipe.

The air atomization combustion chamber has a second combustion chamber stage wherein the additional fuel supply line with the individual nozzles is provided.

It is common to all four above-mentioned burner variants that the combustion chambers are located, even if only partially, in a straight section of increased diameter of the tailpipe. The expanded tailpipe section or the combustion chamber diameter is selected here to be such that the pressure drop of the exhaust gas flowing through will be as small as possible.

The first design variant is designed especially as a vaporizing combustion chamber in the expanded, straight section of the tailpipe, which is preferably used as a so-called soot burner (afterburner) in the tailpipe of a diesel engine.

The vaporizing combustion chamber is designed in the form of a pilot combustion chamber and has a lateral glow means (glow plug, sheathed element glow plug), which is supplied with air and at which the fuel supplied to it is primarily ignited. The pilot combustion chamber is preferably operated at constant output, even though output control may be provided as well.

The pilot combustion chamber exhaust gas-swirling means is on the circumference of its jacket and is maintained by the exhaust gas-swirling means centered in the expanded tailpipe. This swirling means consists preferably of guide blades, which are hollow on the inside and through which the fuel for a second main stage is supplied via fuel lines. Air may also be sent through the guide blades when necessary. The energy contained in the exhaust gas is used for atomization in this form of fuel supply. Supplied fresh air may also be used for this purpose.

A first flame retention baffle, which is preferably designed as a radiating plate, whose shape and geometry are determined experimentally, is located at the outlet of the pilot burner. The radiating plate is used as an ignition aid during operation and as an evaporating surface for the second combustion chamber stage.

The residual oxygen of the engine is preferably used for the combustion in the second combustion chamber stage.

The flame retention baffles mentioned below are useful for maintaining the flame at different exhaust gas mass flow rates. The adjustment of one or more flame retention buffers arranged downstream is performed based on experimentation.

To achieve better mixing of the burner exhaust gases with the engine exhaust gases, the engine exhaust gas may be divided into a primary flow and a secondary flow, which contributes to the cooling of the jacket of the combustion chamber, on the one hand, and brings about good mixing and controlled supply of the engine exhaust gas to the combustion chamber, on the other hand.

The fuel may also be supplied to the second combustion chamber stage via the combustion chamber jacket before or after the exhaust gas-swirling means. This would thus be the actual vaporizing combustion chamber in the conventional sense of the term.

However, the fuel may also be supplied to the second stage via a timing valve (mechanical atomizer nozzle), which injects the fuel directly into the flame of the pilot combustion chamber. As a result, rapid ignition of the second stage takes place in operation, and the full operating capacity of the burner is immediately available.

The first design variant of the present invention has especially the following advantages:

- Only a small amount of air needs to be supplied for the pilot combustion chamber,
- the burner heats the exhaust gas flow directly, as a result of which a homogeneous temperature distribution is obtained in front of the particle filter,
- the evaporating surface is preheated by the exhaust gas of the engine, so that good starting properties are obtained; on the other hand, the evaporating surface is cooled by the engine exhaust gas during the burner operation, so that no thermal overload will develop,
- the burner is insensitive to contamination, which ensures reliable starting behavior,
- the flow can reach the particle filter axially, which means a simplified design and good temperature distribution,
- the burner may be installed between the exhaust gas discharge and the particle filter as desired.

The second design variant is characterized especially by a pilot combustion chamber in the form of a torch igniter in a straight section of increased diameter of the tailpipe, wherein the torch igniter has a lateral flame glow plug with fuel supply and an additional air supply in the form of an air shower (diffuses/diffuser with shower type outlets) arranged in front of it.

The torch igniter advantageously has a lateral ignition air connection and is arranged in a housing which tapers at the downstream end and is open and extends especially coaxially to the tailpipe. The housing may have an engine exhaust gas inlet opening in the upstream direction.

A first and/or second fuel supply lines, which laterally open from the jacket side into the expanded, straight tailpipe section, may be provided before and/or after the torch igniter, i.e., the second embodiment of a burner may be designed for one or two burner stages.

It is advantageous that the flame glow plug used may be of the prior-art design and be supplied with air from the secondary user compressed air system of a motor vehicle. A small, independent air supply may optionally be provided. On the whole, a very simple design is obtained.

The third design variant of a burner also provides for the use of a flame glow plug, which is combined with a vaporizing combustion chamber. Just as the above-mentioned design variants, the above-mentioned components are completely in the exhaust gas flow of an engine in a straight section of increased diameter.

The vaporizing combustion chamber may be designed for a two-stage burner operation and it may ensure a primary exhaust gas flow and a secondary exhaust gas flow due to the design of a cylinder part that is open in front and rear in the tailpipe. The simple design with the use of commercially available components and the use of air from a secondary user compressed air system of a motor vehicle are advantageous here as well.

The latter design variant of the present invention is characterized by an air atomization combustion chamber in a straight section of increased diameter of a tailpipe, likewise operated according to the full exhaust gas mass flow principle.

The air atomization combustion chamber is similar to the first design variant as far as the shape of the combustion chamber is concerned, i.e., a closed, arched flow inlet end located in the upstream direction, as well as an end open in the downstream direction, wherein the exhaust gas flow flows around the jacket circumference of the combustion chamber housing.

An air atomization nozzle, which may be especially a so-called two-component nozzle, i.e., which may have a lateral air supply and a lateral fuel supply line, is preferably located centrally in the air atomization combustion chamber.

The above-mentioned so-called "by-pass burner" may be designed as a single-stage burner or as a two-stage burner. It requires that atomization air from the compressed air system or from a turbocharger or from a separate compressor be provided. The ignition takes place via a spark gap.

The necessary burner output is advantageously generated via a nozzle. The engine exhaust gas flow is split into two partial flows (secondary and primary) and is passed through the combustion chamber as well as past the combustion chamber. The primary exhaust gas flow is mixed with the secondary burner exhaust gas at the end of the air atomization combustion chamber designed in the form of a flame tube, where corresponding guiding means may be present to improve the mixing.

The insensitivity to contamination along with reliable ignition is especially advantageous. Moreover, good premixing of the air and fuel is achieved directly at this outlet, and there is consequently no separation. The ignition takes place very rapidly, as in the case of a switch. In particular, the burner output is very good, and it is available in a short time after start-up. This design variant otherwise has the same advantages as the above-mentioned design variants.

It should be mentioned that the burner output can be controlled mechanically via a speed-dependent fuel admission pressure and by means of an expanding element acting as a needle lift transducer. The nozzle needle is coupled with an expanding element here. Like the burner, the expanding element is also located in the full exhaust gas mass flow and it changes the lift of the nozzle needle and consequently also the amount of fuel as a function of the exhaust gas temperature. The fuel admission pressure will build up as a function of the engine speed (as in prior-art distributor injection pumps). Thus, the amount of fuel injected depends on the exhaust gas temperature and the speed. The mass of the exhaust gas is proportional to the engine speed in the case of naturally aspirated engines. Mechanical burner output control is thus possible. The load signal (e.g., charging pressure) must be sent in the case of turbocharged and charge-cooled engines, e.g., the charging pressure-speed pressure controller - fuel pressure information. The expanding element must be adapted to the necessary burner output and the engine.

The above-mentioned mechanical burner output control has a simple design and requires only an igniting device, a triggering signal, and a fuel release signal.

In the above-mentioned design variants, air can be supplied, in general, via an air shower (diffuser element) or it can be added directly in the combustion chamber for combustion for improved mixing in the case of insufficient supply by the residual oxygen of the engine exhaust gas.

To form or improve a homogeneous, ignitable mixture, it may be useful to provide corresponding guiding means, especially guide blades, in front of the fuel supply point.

The entire regeneration time can be reduced by the use of vaporizing burners in the exhaust gas if the burner is also ignited when the engine is started and is operated at a low output. When regeneration is required, the burner output can then be increased immediately, without a long start-up procedure.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
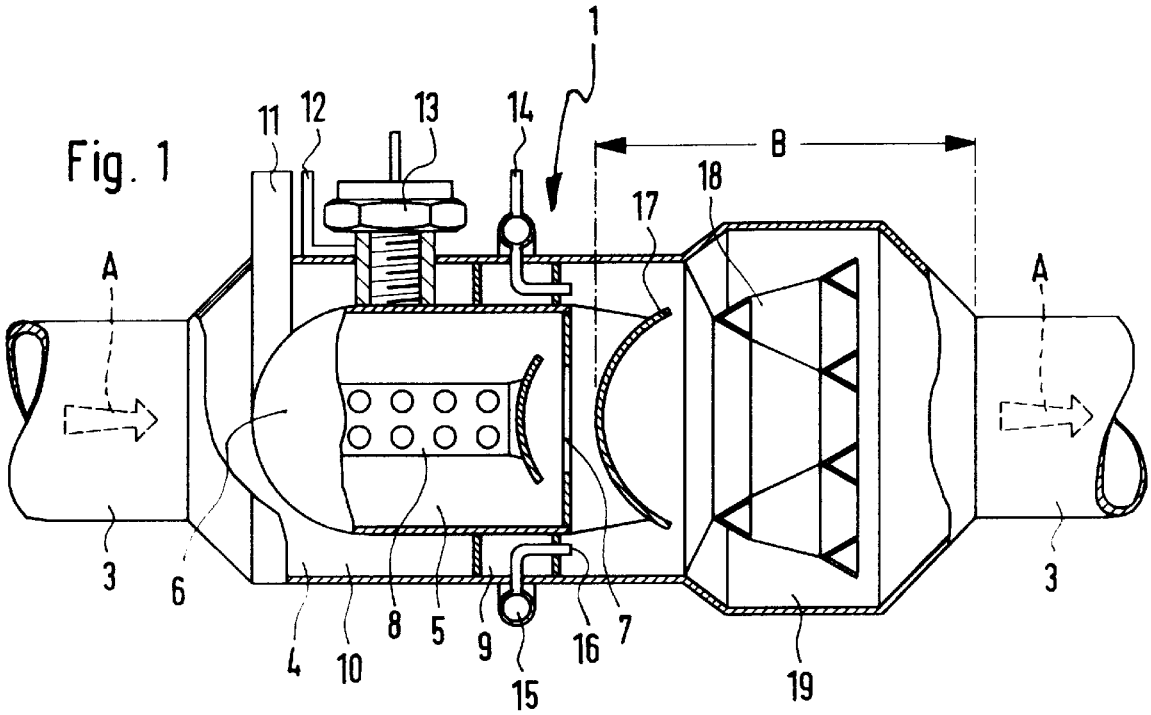
FIG. 1 is a schematic axial sectional view of a first design variant of a full-flow burner in the area of a straight tailpipe section of increased diameter.

According to FIG. 1, a burner 1 for the thermal regeneration of a particle filter (not shown) is provided in an exhaust gas aftertreatment system of an internal combustion engine, especially a diesel engine. The burner 1 is located entirely in the exhaust gas flow. According to the drawing, the exhaust gas flow A arrives from the left from the exhaust gas turbocharger and flows after the burner 1 to the particle filter in the tailpipe, which is located to the right according to FIG. 1.

The burner 1 according to the first design variant in FIG. 1 has a central, coaxial vaporizing combustion chamber 5, which has a closed, arched flow inlet end 6 in the upstream direction and is provided with an opening 7 in the downstream direction. The flow bypasses the full-flow burner in the tailpipe of a diesel engine (it can also be used as a burner of a catalytic converter for a spark ignition engine) on the jacket circumference during operation due to the vaporizing combustion chamber being arranged inside the expanding, straight tailpipe section. The combustion chamber diameter is selected to be such that the pressure drop on the combustion chamber is as low as possible.

The vaporizing combustion chamber 5 (or pilot combustion chamber) has a central section in the form of a perforated pipe 8, which extends coaxially to the axis of the tailpipe 3. On the whole, the vaporizing combustion chamber 5 is held and centered in the expanded tailpipe section 4 by a first exhaust gas-swirling means 9, which is located in the jacket annular space 10. The first exhaust gas-swirling means 9 has especially guide blades, which are hollow on the inside, for a purpose to be described below.

The flow inlet end 6 of the vaporizing combustion chamber 5, which is arched in the upstream direction, comprises a first lateral air inlet channel 11, which is led through the jacket of the expanded tailpipe section 4.

The vaporizing combustion chamber 5 also comprises a first lateral fuel supply means 12 with a lateral glow means 13 (sheathed element glow plug, glow plug), by which the fuel supplied is primarily ignited ("pilot combustion chamber").

The vaporizing combustion chamber or the pilot combustion chamber may be followed by a second combustion chamber stage B, as is shown in FIG. 1.

The second combustion chamber stage B comprises a second lateral fuel supply means 14, which introduces the second fuel into the jacket annular space 10 in the area of the first exhaust gas-swirling means 9 via a closed circular line, wherein the fuel opening end 16 of the second fuel supply extends toward the downstream side and is opened there. In the exemplary embodiment according to FIG. 1, the second fuel supply 14 extends in the area of the first exhaust gas-swirling means 9 inside the hollow guide vanes, in corresponding holes.

The opening 7 of the vaporizing combustion chamber 5 is followed in the downstream direction by a first flame retention baffle 17 in the form of a radiating plate, which is an ignition aid and an evaporating surface for the second combustion chamber stage B.

The first flame retention baffle 17 is followed, in an additionally expanded tailpipe section 19, by one or more additional coaxial flame retention baffles 18, which are fastened to the inner circumference of the expanded or enlarged tailpipe section.

The vaporizing combustion chamber is preferably operated at constant output during operation. The so-called pilot combustion chamber, which is supplied with air, is ignited via the glow means 13, by which the primary fuel supply is ensured as well. The exhaust gas flow A, which is additionally mixed with the second fuel supply 14 and is swirled by the exhaust gas-swirling means 9, is then ignited in the so-called main combustion chamber behind the first flame retention baffle 17 in the downstream direction. The flame retention baffles 18 arranged farther behind ensure the stabilization of the flame in different exhaust gas mass flows. The burner can be placed into the exhaust gas flow somewhere between the exhaust gas outlet of the diesel engine and the particle filter.

Figure 2:
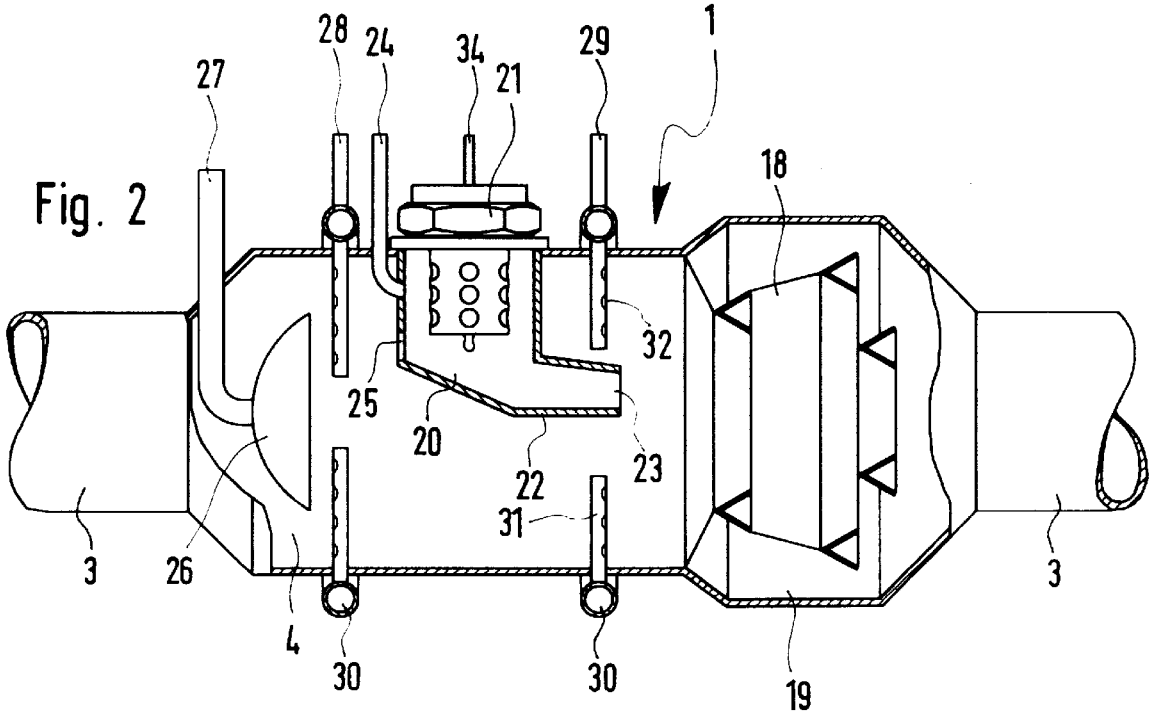
FIG. 2 is a schematic sectional view similar to FIG. 1 of a second design variant of a full-flow burner.

The second design variant of a burner 1 for the thermal regeneration of a particle filter, which is illustrated in FIG. 2, is also provided as a so-called full-flow burner in a straight tailpipe section 4 of increased diameter similar to that in FIG. 1. The expanded tailpipe section 4 is provided with a pilot combustion chamber in the form of a torch igniter 20 with lateral flame glow plug 21, and the torch igniter 20 is fastened to the jacket of the tailpipe section 4. The housing 22 of the torch igniter 20 has an open end 23, which tapers in the downstream direction and extends coaxially to the tailpipe 3 or the expanded tailpipe section 4. The housing 22 of the torch igniter 20 has an engine exhaust gas inlet opening 25 in the upstream direction. A lateral igniting air connection 24, which extends through the jacket of the expanded tailpipe section 4, is also located in the area of the inlet opening 25.

The torch igniter 20 is preceded in the upstream direction by a central air shower (diffuser) 26, which has a lateral connection piece 27 for supplying additional air.

A first fuel supply line 28 is located behind the air shower 26, and a second fuel supply line 29 is located behind the torch igniter 20, and the two fuel supply lines 28 and 29 are provided with a closed circular line 30 on the jacket and have line webs 31 extending radially into the interior of the tailpipe section 4. The line webs 31 have a series of outlet openings 32 in the downstream direction for the optimal mixing of the fuel with the air and the exhaust gas flow A.

The torch igniter, designed as a two-stage igniter according to FIG. 2, also has one or more additional coaxial flame retention baffles 18, which are arranged after the second fuel supply line 29 in the downstream direction, are located in a second, expanded tailpipe section and ensure the stabilization of the flame in the reaction space of the second tailpipe section located there.

Figure 3:
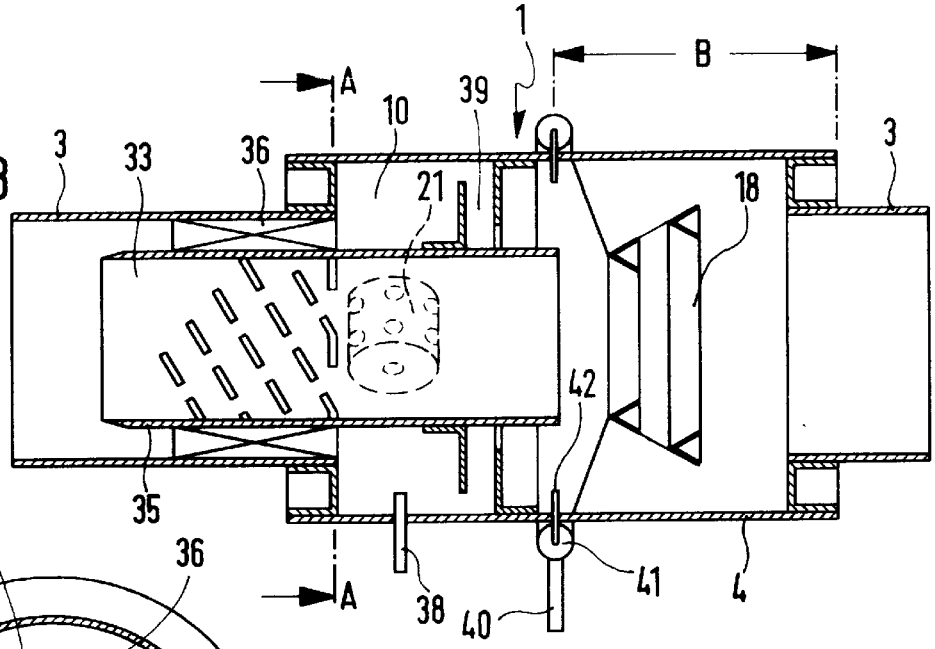
FIG. 3 is a schematic sectional view similar to FIGS. 1 and 2 of a third design variant of a full-flow burner.
Figure 4:
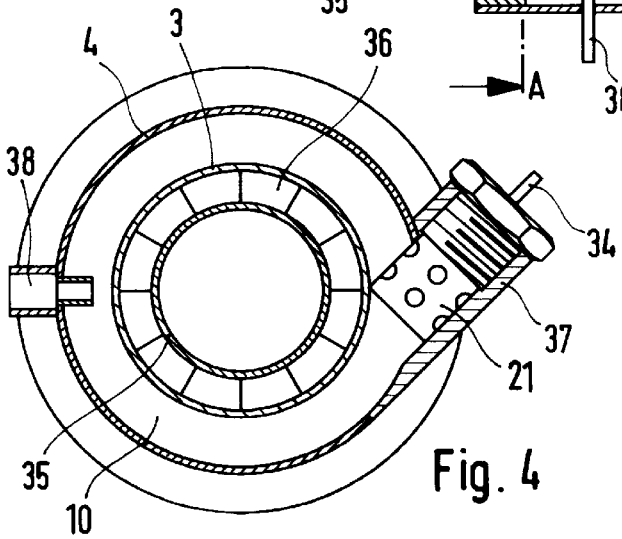
FIG. 4 is a schematic cross sectional view through the burner according to FIG. 3 along line A—A.

Like the above-described second exemplary embodiment, the exemplary embodiment of a full-flow burner 1 shown in FIGS. 3 and 4 provides for a flame glow plug 21 with a primary fuel supply 34, doing so in a two-stage vaporizing combustion chamber 33 with a coaxial cylinder part 35, which is concentrically fastened circumferentially in the tailpipe 3 or in the expanded tailpipe section 4 via a second exhaust gas-swirling means 36 and an exhaust gas-deflecting means 39.

The second exhaust gas-swirling means 36 has oblique baffle plates in the manner of a screw thread and is located on the upstream side of the cylinder part 35. The exhaust gas-deflecting means 39 comprises individual angular baffle plates and is located at the downstream end of the cylinder part 35.

Due to the cylinder part 35 being open in the front and in the rear, exhaust gas can flow primarily directly through the cylinder part, and the secondary exhaust gas flow is subjected to intense swirling through the means 36 and 39.

A second fuel supply 38 is located between the latter means 36 and 39, and fuel can be mixed with the swirled secondary exhaust gas flow by this second fuel supply 38 radially through the expanded tailpipe section. The second vaporizing combustion chamber 33 has, for a second combustion chamber stage B, a third fuel supply 40 with a closed circular line 41 on the jacket, similarly to the second fuel supply 38. The pre-combusted secondary exhaust gas flow, extremely swirled by the exhaust gas-deflecting means 39, is thus further mixed with a third fuel and subjected to afterburning together with the primary exhaust gas flow in the second combustion chamber stage, where the flame is stabilized by additional flame retention baffles 18 located there before the treated hot exhaust gas flow is fed to the particle filter (not shown).

Figure 5:
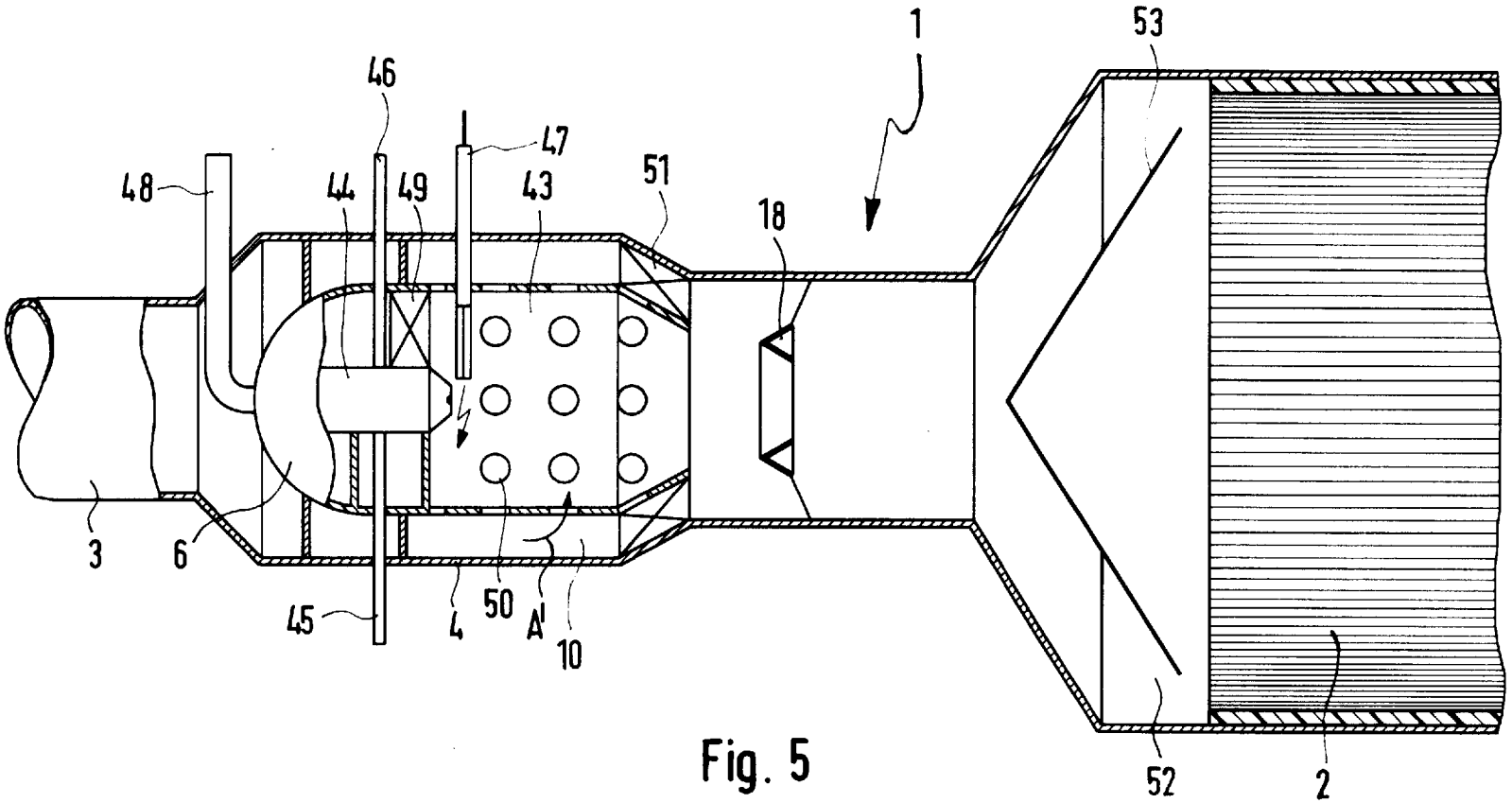
FIG. 5 is a schematic axial sectional view of a fourth design variant of a full-flow burner similar to the above design variants.

The exemplary embodiment of a full-flow burner 1 shown in FIG. 5 is characterized especially by a straight tailpipe section 4 of increased diameter, in which an air atomization combustion chamber 43, which has a closed, arched flow inlet end 6 similar to the first design variant in the upstream direction and is open, especially tapered, in the downstream direction, is arranged coaxially. The air atomization combustion chamber, forming a jacket annular space 10, is held concentrically in the expanded tailpipe section 4. The exhaust gas flow A flows through the jacket annular space 10.

The air atomization combustion chamber 43 has a central air atomization nozzle 44 and is designed as a so-called two-component nozzle, i.e., it is provided with a lateral fuel supply line 45 and a lateral air supply line 46. The nozzle 44 is held in a central position inside the air atomization combustion chamber by an air swirling guide means 49. The air atomization nozzle 44 is followed by a lateral ignition means 47.

The arched flow inlet end 6 of the air atomization combustion chamber 43, which is closed in the upstream direction and is a so-called "by-pass combustion chamber," has an additional air supply line 48, which opens radially and additionally supplies the interior of the combustion chamber with air.

The downstream part of the air atomization combustion chamber 43 is designed as a so-called flame tube and has a plurality of jacket openings 50, through which a primary exhaust gas flow A' is guided from the jacket annular space side into the interior of the flame tube and combusted. The primary exhaust gas flow A' unites after the exhaust gas guide means 51 in a so-called mixing section, which is provided with an additional flame retention baffle 18.

After the additional flame retention baffle 18, a splitting is performed in an expanded exhaust gas-mixing space 52, in which a splitting guide means 53 with conically expanded baffle plates is located. After the mixing space 52, the very hot afterburned exhaust gases are sent to the particle filter 2 proper, which is then freed by burning off the particles or of soot for regenerating the filter.

Figure 6:
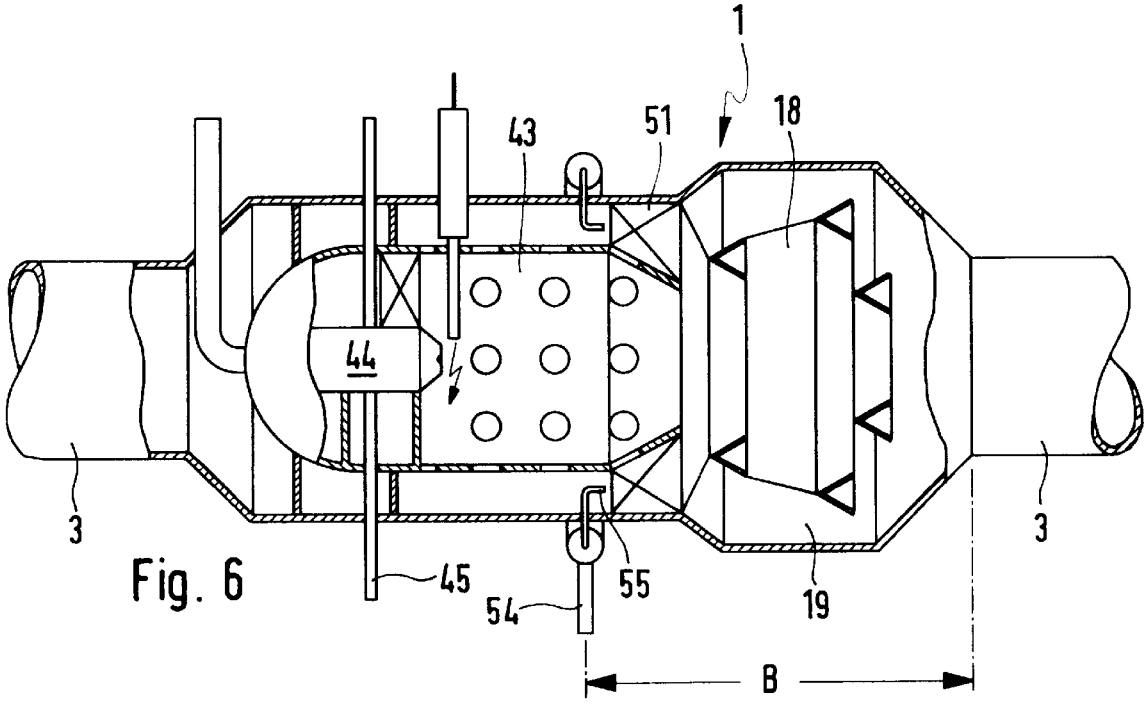
FIG. 6 is a schematic axial sectional view of a modified version of the design variant according to FIG. 5 with a second combustion chamber stage.

The exemplary embodiment of a full-flow burner 1 shown in FIG. 6 extensively corresponds to the exemplary embodiment according to FIG. 5, but, unlike the latter, it has a second combustion chamber stage B. The second combustion chamber stage B comprises an additional fuel supply line 54 with a closed circular line on the jacket and individual nozzles 55 at a short distance before the exhaust gas guide means 51 in the jacket annular space 10, as well as a downstream tailpipe section 19 of increased diameter with additional flame retention baffles 18 similar to FIGS. 1 and 2.

While specific embodiments of the invention have been shown and described in detail to illustrate the application of the principles of the invention, it will be understood that the invention may be embodied otherwise without departing from such principles.

What is claimed is:

1. A burner for the thermal regeneration of a particle filter arranged in a tailpipe of an internal combustion engine, the burner comprising:

a tailpipe section of increased diameter;

a vaporizing combustion chamber disposed centrally and coaxially with respect to said section of increased diameter, said vaporizing combustion chamber including a closed, arched flow inlet end in an upstream direction relative to exhaust gas flow and having an opening in a downstream direction, said section of increased diameter cooperating with said vaporizing combustion chamber to define a jacket space comprised of a substantially annular exhaust gas flow passage, disposed around said vaporizing combustion chamber, on a jacket circumference of said vaporizing combustion chamber, said gas flow passage having a substantially constant magnitude from said inlet end to said opening in said downstream direction.

2. A burner according to claim 1, wherein said vaporizing combustion chamber includes a central combustion chamber section including a coaxial perforated pipe.

3. A burner according to claim 2, wherein said vaporizing combustion chamber is held and centered with respect to said section of increased diameter by an exhaust gas-swirling means arranged in said jacket space.

4. A burner according to claim 3, wherein said first exhaust gas-swirling means includes guide blades.

5. A burner according to claim 1, wherein said upstream flow inlet end of said vaporizing combustion chamber includes a lateral air inlet channel.

6. A burner according to claim 1, wherein said vaporizing combustion chamber includes a lateral fuel supply with lateral glow plug means for ignition of fuel supplied to said vaporizing combustion chamber.

7. A burner according to claim 1, wherein said vaporizing combustion chamber is followed by an additional combustion chamber stage.

8. A burner according to claim 7, wherein said additional combustion chamber stage includes an additional combustion chamber lateral fuel supply with a closed circular line, said additional combustion chamber lateral fuel supply introducing fuel into said jacket space in an area of an exhaust gas-swirling means, a fuel opening end of said second fuel supply being downstream of said jacket space.

9. A burner according to claim 8, wherein said additional combustion chamber fuel supply extends at least partially in an interior of said exhaust gas-swirling means and extends through holes formed in guide blades of said exhaust gas-swirling means.

10. A burner according to claim 7, wherein said additional combustion chamber fuel supply is connected to one of a timing valve and mechanical atomizer for injecting fuel directly into a flame of said vaporizing combustion chamber.

11. A burner according to claim 7, wherein said vaporizing combustion chamber is followed, in a downstream direction by a flame retention baffle providing a radiating plate forming an ignition aid and evaporating surface for said additional combustion chamber.

12. A burner according to claim 11, wherein said flame retention baffle is coaxially followed by additional flame retention baffles, in said downstream direction.

13. A burner according to claim 12, wherein said additional flame retention baffles are arranged concentrically in said tailpipe section of increased diameter.

14. A burner according to claim 7, wherein combustion air of said additional combustion chamber stage is provided in the form of residual air of the exhaust gas of the internal combustion engine.

15. A burner according to claim 1, further comprising;

means for dividing said engine exhaust gas flow into a primary flow and a secondary flow for better mixing of burner exhaust gas.

16. A burner for the thermal regeneration of a particle filter arranged in a tailpipe of an internal combustion engine exhaust, the burner comprising:

a straight tailpipe section having a diameter larger than a diameter of the tailpipe;

an air atomization combustion chamber with a closed, arched flow inlet end in an upstream direction, an open end in a downstream direction and a substantially straight cylindrical flame tube between said inlet end and said open end, a jacket of said air atomization combustion chamber and said straight tailpipe section cooperating to define an annular space for exhaust gas flow therethrough, said atomization combustion chamber being arranged coaxially with respect to said straight tailpipe section of increased diameter, said gas flow passage having a substantially constant magnitude between said flame tube and said straight tailpipe section.

17. A burner according to claim 16, wherein said air atomization combustion chamber includes a central air atomization nozzle provided with a radial fuel supply line and with a radial air supply line, said air atomization nozzle being followed in a downstream direction by a radial igniting means.

18. A burner according to claim 16, wherein said arched flow inlet end of said air atomization combustion chamber includes an additional radial air supply line.

19. A burner according to claim 18, wherein said radial fuel supply line and said air supply line are followed in a downstream direction by air swirling guide means, said air swirling guide means additionally forming a holder of said air atomization nozzle within said air atomization combustion chamber.

20. A burner according to claim 17, wherein said air atomization combustion chamber is formed of a flame tube with jacket openings.

21. A burner according to claim 20, wherein said flame tube includes a downstream end which is tapered, an exhaust gas guide means being disposed within the tailpipe, said exhaust gas guide means fastening said flame tube to an inner circumferential surface of said section of increased diameter.

22. A burner according to claim 16, further comprising one or more additional coaxial flame retention baffles arranged behind said air atomization combustion chamber.

23. A burner according to claim 22, wherein said additional flame retention baffles are followed by an expanding coaxial mixing space including a mixing space guide means, said coaxial mixing space being connected to the particle filter in the tailpipe.

24. A burner according to claim 16, wherein said air atomization combustion chamber includes an additional combustion stage with an additional fuel supply line, said additional fuel supply line including a plurality of individual nozzles.

25. A burner for the thermal regeneration of a particle filter arranged in a tailpipe of an internal combustion engine, the burner comprising:

a tailpipe section having a diameter larger than a diameter of the tail pipe;

a combustion chamber disposed in said tail pipe section, said combustion chamber being arranged completely in said tailpipe section, said combustion chamber including a closed, arched flow inlet end in an upstream direction relative to exhaust gas flow, and a downstream end defining an opening, said section of increased diameter cooperating with said combustion chamber to define an annular exhaust gas flow passage disposed around said combustion chamber, and on a jacket circumference of said combustion chamber, said annular exhaust gas flow passage having a substantially constant magnitude from said inlet end to said downstream direction.

26. A burner in accordance with claim 25, wherein:

said combustion chamber is a central coaxial vaporizing combustion chamber.

27. A burner in accordance with claim 25, wherein:

said combustion chamber is a pilot combustion chamber in a form of a torch igniter with a lateral flame glow plug, said combustion chamber is fastened to the jacket of the said expanded tailpipe section, said torch igniter has a housing with a downstream tapering open end which extends axially in parallel to said tailpipe section.

28. A burner in accordance with claim 25, wherein:

said combustion chamber includes a portion positioned in said tailpipe section, said combustion chamber including a glow plug connected to a fuel supply.

29. A burner in accordance with claim 25, wherein:

said combustion chamber is an air atomization burner.

30. A burner in accordance with claim 25, wherein:

said combustion chamber has an exhaust opening arranged inside said tailpipe section and spaced from walls of said tailpipe section.

31. A burner in accordance with claim 25, wherein:

said downstream end of said combustion chamber is conically tapered;

said tail pipe section defines a mixing section downstream of said downstream end of said combustion chamber;

an exhaust gas guide means connects said conically tapered downstream end to said tail pipe section and guides the exhaust gas from said annular exhaust gas flow passage to said mixing section.

32. A burner in accordance with claim 31, wherein:

said exhaust gas guide means is a flow though swirl means for swirling the exhaust gas.

33. A burner in accordance with claim 25, further comprising:

a central air atomization nozzle, a radial fuel supply line and a radial air supply line provided in said combustion chamber;

air swirling guide means connecting said nozzle to said combustion chamber and for swirling air from said air supply line.

34. A burner in accordance with claim 25, wherein:

said tail pipe section defines a mixing section downstream of said downstream end of said combustion chamber;

a flame retention baffle is positioned in said mixing section.

35. A burner in accordance with claim 34, wherein: a splitting guide means is positioned downstream of said flame retention baffle and splits the exhaust gas in an expanded exhaust gas mixing space, said mixing space having a larger diameter than a diameter of said mixing section.

36. A burner in accordance with claim 35, wherein:

said downstream end of said combustion chamber is conically tapered;

an exhaust gas guide means connects said conically tapered downstream end to said tail pipe section and guides the exhaust gas from said annular exhaust gas flow passage to said mixing section, said exhaust gas guide means is a flow though swirl means for swirling the exhaust gas;

a central air atomization nozzle, a radial fuel supply line and a radial air supply line are provided in said combustion chamber;

air swirling guide means connects said nozzle to said combustion chamber and swirls air from said air supply line;

said arch, flow inlet end has a substantially hemispherical shape.

37. A burner in accordance with claim 36, further comprising:

an additional nozzle positioned in said annular exhaust gas passage upstream of said exhaust gas guide means and forming a secondary combustion chamber in said mixing section.

38. A burner in accordance with claim 31, further comprising:

an additional nozzle positioned in said annular exhaust gas passage upstream of said exhaust gas guide means and forming a secondary combustion chamber in said mixing section.

* * * * *